US006554519B1

(12) United States Patent
Kaplan

(10) Patent No.: US 6,554,519 B1
(45) Date of Patent: Apr. 29, 2003

(54) NOTE PAD HOLDER WITH INTEGRATED WRITING INSTRUMENT

(76) Inventor: Matthew Kaplan, 4343 Althea Way, Palm Beach Gardens, FL (US) 33410

( * ) Notice: Subject to any disclaimer, the term of this patent is extended or adjusted under 35 U.S.C. 154(b) by 0 days.

(21) Appl. No.: 09/976,332

(22) Filed: Oct. 11, 2001

(51) Int. Cl.[7] ..... B43K 23/02
(52) U.S. Cl. ..... 401/131; 401/195; 401/99
(58) Field of Search ..... 401/131, 195, 401/109, 112, 117, 48; 206/371, 215

(56) References Cited

U.S. PATENT DOCUMENTS

| | | | | | |
|---|---|---|---|---|---|
| 1,577,272 | A | * | 3/1926 | Treadaway | 401/99 |
| 2,512,168 | A | | 6/1950 | Moore | |
| 3,092,244 | A | * | 6/1963 | McWhirter | 401/195 |
| 3,963,358 | A | | 6/1976 | Houser | |
| 3,994,605 | A | * | 11/1976 | McKnight | 401/99 |
| 4,872,775 | A | | 10/1989 | Chang | |
| 6,039,492 | A | * | 3/2000 | Chen | 401/195 |
| 6,247,864 | B1 | | 6/2001 | Walsh | |

* cited by examiner

*Primary Examiner*—David J. Walczak
(74) *Attorney, Agent, or Firm*—McHale & Slavin, P.A.

(57) ABSTRACT

A notepad holder with an integrated writing instrument which includes a writing instrument disposed in a generally rectangular housing having a base section and a hingedly connected lid section. The base section has a top surface, opposing side surfaces and opposing front and rear surfaces. The top surface includes a rectangular recess which cooperates with the lid section to form an accessible interior compartment within the housing. The writing instrument is disposed in the housing in an interior chamber proximate to one of the opposing side surfaces. The front surface of the base section has an aperture axially aligned with said writing instrument so that the tip of the writing instrument can project from the housing. The device includes a means to alternatively selectively position the writing tip between a retracted position enclosed within the housing and a projected position extending through the aperture. In the preferred embodiment, the device includes a notepad disposed in the rectangular recess. At least one of said opposing side edges can include a vertically oriented arcuate recess adapted to facilitate manual gripping of the device by a user to utilize the writing instrument.

11 Claims, 7 Drawing Sheets

NOTE PAD HOLDER WITH INTEGRATED WRITING INSTRUMENT

FIELD OF THE INVENTION

This invention relates generally to the field of writing instruments, and more particularly to a notepad holder with an integrated writing instrument which is self-contained and small in size for convenient carrying.

BACKGROUND OF THE INVENTION

Most people find that the need for a pen and writing paper can arise frequently as they go about their daily routines. Women can store pens and writing paper in their handbags, but since men do not typically carry handbags, they may find carrying writing materials to sometimes be problematic. Of course, it can happen that one has either a pen, or paper, but not both in their possession at the time it is required.

To this end, it would be desirable to provide a single item which combines a writing instrument with a supply of writing paper. Examples of paper holding pens in the prior art include Moore, U.S. Pat. No. 2,512,168, Houser, U.S. Pat. No. 3,963,358, Chang, U.S. Pat. No. 4,872,775, and Walsh, U.S. Pat. No. 6,247,864. Each of these references disclose a conventional pen having a roll of paper disposed therein which is dispensed through a lateral slot. The paper holding pens of the prior art are normal sized, i.e. approximately 6 inches long. There are some instances where carrying a pen of a conventional size and configuration can be difficult or inconvenient. It would therefore desirable to provide a more compact and durable device which combines a writing instrument with a source of writing paper that those described in the prior art. Also, a writing instrument which can contain a bound notepad would be far more convenient than the prior art pens which only dispense narrow strips of paper.

SUMMARY OF THE INVENTION

It is an objective of the invention to provide a notepad holder with an integrated writing instrument which is relatively small in size and convenient to carry.

It is another objective to provide a notepad holder with an integrated writing instrument which is a unitary piece, without removable elements which can become lost.

It is still another objective to provide a notepad holder with an integrated writing instrument which is durable in construction and not easily damaged.

It is a further object of the invention to provide a combination writing instrument and notepad holder which is designed to be ergonomically easy to use.

It is yet a further object of the invention to provide a notepad holder with an integrated writing instrument which is inexpensive and easy to manufacture.

Yet still another objective of the instant invention is to disclose a notepad holder with an integrated writing instrument that can be placed within a wallet.

In accordance with the above objectives, a notepad holder with an integrated writing instrument is provided which comprises a generally rectangular base section defined by a top surface, opposing front and rear surfaces, and opposing left and right side surfaces. The top surface has a recessed area with opposing side surfaces and opposing front and rear surfaces. The base has an instrument chamber therein adjacent to the recessed area, and the front surface includes an aperture aligned with the instrument chamber. A writing instrument which includes a writing tip is stored within the instrument chamber. The device includes a means to alternatively selectively position the writing tip between a retracted position within the instrument chamber and a projected position extending through the aperture. A lid section is hingedly coupled to the base section to provide a cover for the recessed area, wherein the recessed area is available for holding various sized notepads whereby said writing instrument is available for a user to write messages on the notepad. At least one of said opposing side edges includes an vertically oriented arcuate recess adapted to facilitate manual gripping of the device by a user to utilize the writing instrument.

In the preferred embodiment, the combination writing instrument and notepad holder includes a notepad disposed in the rectangular recess. The housing can be formed from injection-molded plastic, or any other suitable rigid, lightweight material.

The means to alternatively selectively position the writing tip between a retracted position and a projected position comprises an elongated slot in the housing having first and second sets of extending tab slots extending laterally and perpendicularly therefrom. The first set corresponds to a retracted position and said second set corresponds to a projected position. A sliding button is slidably disposed in the slot and is integrally formed with a clamp assembly fixedly attached to the writing instrument. The button includes integrally formed lateral tabs adapted to engage with one set of the tab slots, wherein the tabs are seated in the first set of tabs slots in retracted position and in the second set of tab slot in the projected position. The sliding button can be manually depressed to unseat said tabs from said tab slots by downwardly displacing said sliding button. The projection/retraction assembly includes a spring biasing means wherein the tabs are urged upwardly to reseat themselves in one set of tab slots after downward displacement.

In an alternative embodiment, the means to alternatively selectively position the writing tip between a retracted position and a projected position comprises elongated slot and a retraction button aperture extending thorough the side surface of said base, a button slidably disposed in said slot which is integrally formed with a clamp assembly fixedly attached to the writing instrument, a spring slidably disposed on the writing instrument which is captured between the aperture in the front face of the base and the clamp assembly, an extension member extending from the clamp assembly which terminates in a retraction button. The retraction button is seated in the retraction button aperture when the writing tip is in a projected position. When the retraction button is manually unseated from the retraction button aperture, the tension in the spring will spring will urge the writing instrument to the retracted position.

The writing instrument can be a ball point pen, a felt pen, a mechanical pencil, or any other conventional writing implement.

DETAILED DESCRIPTION OF THE INVENTION

Figure 1:
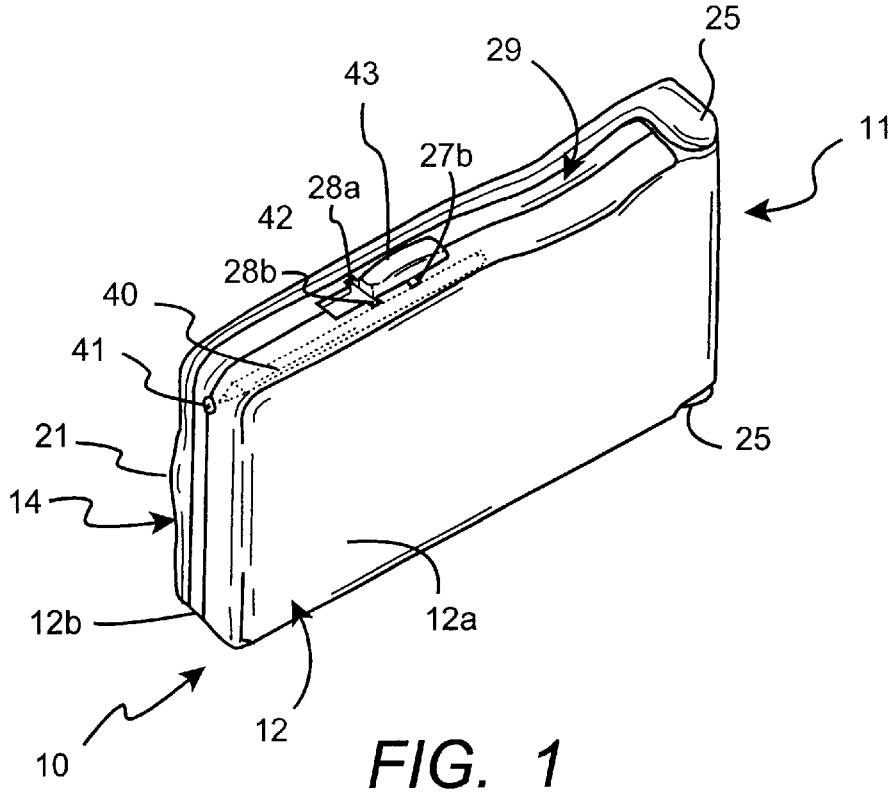
FIG. 1 is a perspective view of notepad holder with an integrated writing instrument according to a preferred embodiment of the present invention taken from the bottom and right, in which the device is in a closed and retracted configuration.

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

The device 10, as illustrated in FIGS. 1–10, is notepad holder with an integrated writing instrument according to a preferred embodiment of the invention. The device 10 consists of a writing instrument 40 (depicted in phantom in FIG. 1) disposed in a generally rectangular housing 11. The writing instrument 40 can be any conventional implement, such as a ball point pen, felt pen, gel ink cartridge pen, a mechanical pencil, a marker type pen, or a crayon-type writing instrument. A stated object of the present invention is to provide a combination writing instrument and notepad holder which is relatively small in size, and the writing instrument 40 utilized in the present invention is necessarily substantially smaller in size than a standard writing pen.

The housing 11 has a base section 12 having opposing front and rear surfaces and opposing left and right side surfaces and a hingedly connected lid section 14. In the illustrated embodiment, the lid 14 is pivotally connected at a rear edge of the housing 11, however, the lid 14 can be attached at any peripheral edge of the base 12. The lid 14 can include a raised tab portion 21 to enable the user to easily lift the lid 14 to an open position. A tab 35 having an aperture 35*a* extending therethrough can be provided to allow the user to attach the device 10 to, for example, a cord or keychain.

The writing instrument is positioned within the base section 12 proximate to one of the opposing side surfaces 13*a* and 13*b* of the base section 12. The base section 12 includes an aperture 19 extending through the front surface 16 which is axially aligned with the writing instrument 40. A button 43 slidably disposed within a slot 42 provides a means to manually project and retract the writing instrument 40 through the aperture 19, as will be described in detail hereinafter.

Figure 2:
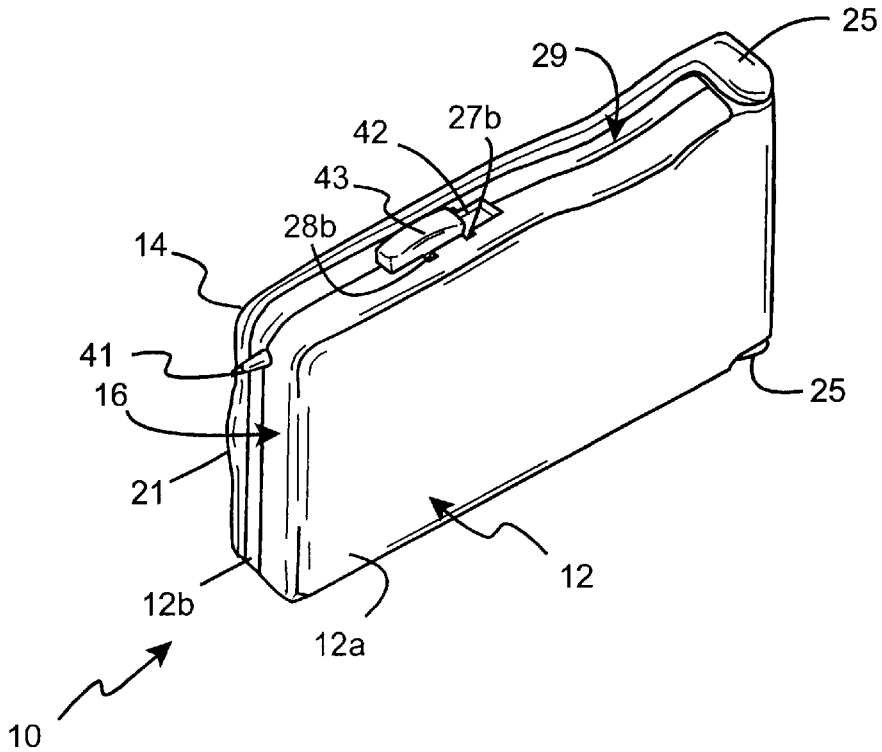
FIG. 2 is a perspective view of the device shown in FIG. 1, in which the device is in a closed and projected configuration.
Figure 3:
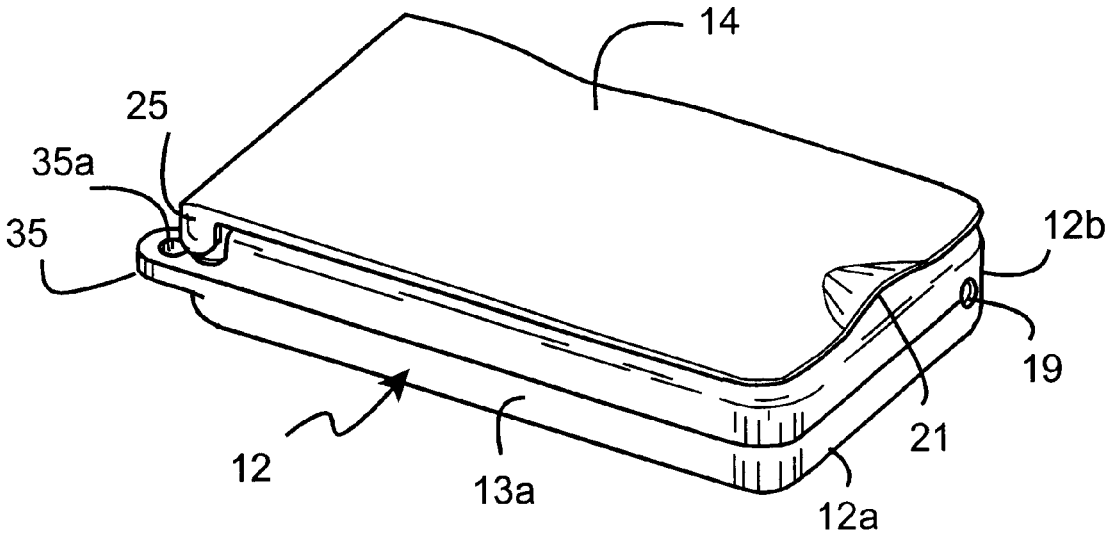
FIG. 3 is a top perspective view of the device shown in FIG. 1, taken from the front and left.
Figure 4:
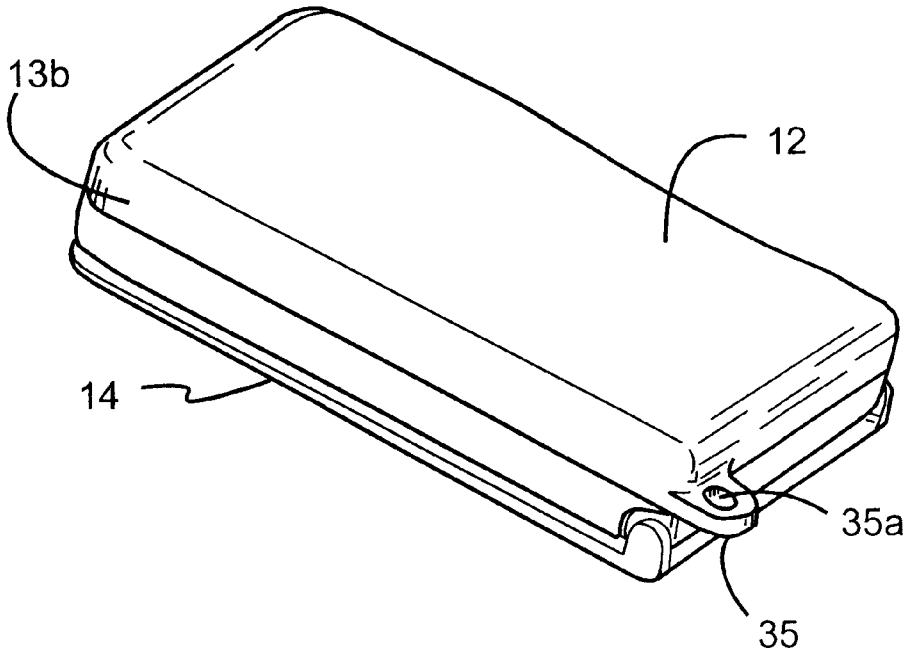
FIG. 4 is a bottom perspective view of the device shown in FIG. 1, taken from the rear and right.

FIGS. 1, 3 and 4 show the device 10 in a closed configuration, in which the lid section 14 is closed and the writing instrument 40 is retracted. In FIG. 2, the writing instrument 40 is in a projected position so that the tip 41 of the writing instrument 40 extends through the aperture 19. In this projected position, the user can grip the device 10 and write with the writing instrument 40 in a normal manner. For ease of description and to establish a directional reference, the device 10 is described and illustrated herein as a writing instrument to be used by in the right hand of a person. It will be appreciated that the specifications of the device 10 can be also constructed to be a mirror image of the one described to accommodate a left-handed person.

The left and right sides 13*a,b* of the base section 12 can be contoured to facilitate manual gripping of the device 10 to utilize writing instrument 40. In the preferred embodiment, the right side 13*b* includes an arcuate recess 29 which serves to provide the device 10 with an ergonomically functional form. The lid section 14 can be similarly contoured. When writing, the arcuate recess 29 would rest between the thumb and index finger of the user.

Figure 5:
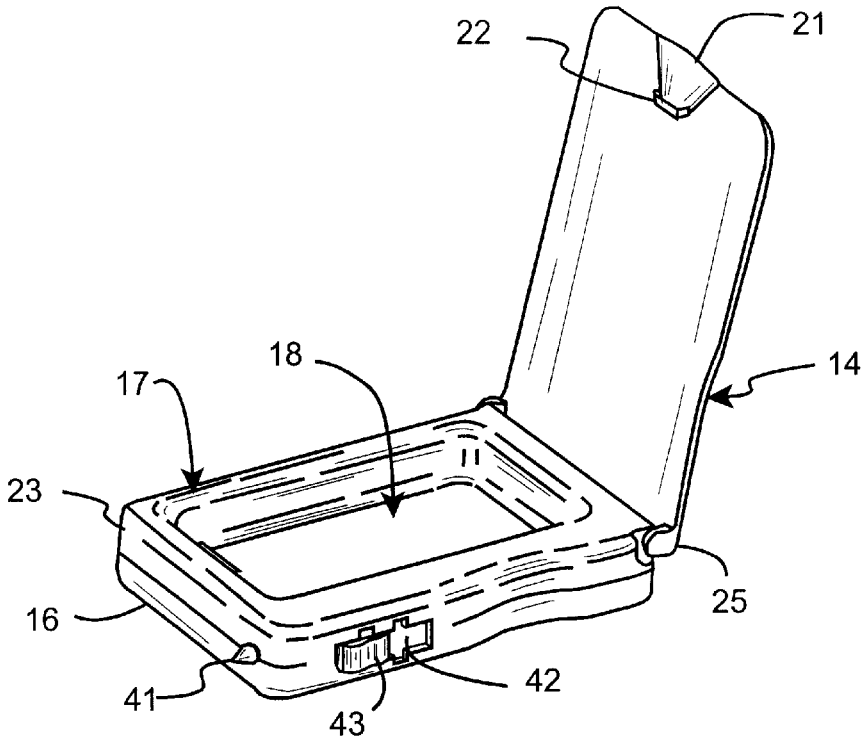
FIG. 5 is a perspective view of the device shown in FIG. 1 taken from the front and right in an open configuration in which the writing tip of the writing instrument is in a projected position.
Figure 6:
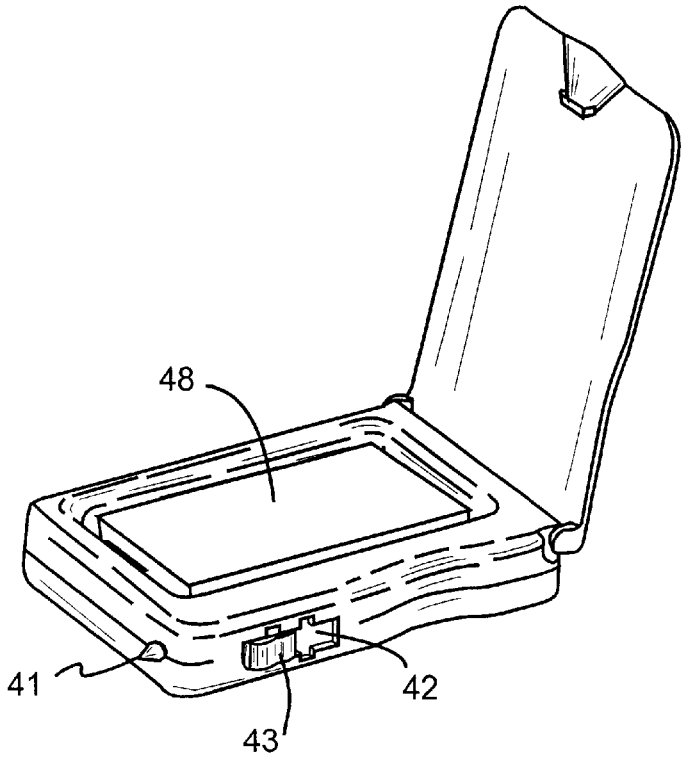
FIG. 6 is a perspective view of the device shown in FIG. 1 in an open configuration showing a notepad disposed therein.

FIG. 5 illustrates the device 10 in an open configuration. The lid section 14 is attached to the base section 12 by a hinge assembly 25. The lid section 14 and base section 12 respectively include mating latch portions 22 and 23 which serve to secure the lid 14 in the closed position. The top surface 17 of the base section 12 includes a rectangular recess 18 which cooperates with the lid 14 to form an accessible interior compartment with in the housing 11. The recess 18 has a planar lower surface, and vertically extending side walls defining opposing side surfaces and opposing front and rear surfaces. The recess 18 is configured to hold a notepad 48, as shown in FIG. 6. In the practice of the invention, the notepad can be sized to closely correspond with the dimensions of recess 18. The notepad 48 is removable, and the recess 18 can also be used to store any items as might be desired by the user.

The base section 12 can be constructed from interfitting components for ease of assembly in the manufacturing process. In the preferred embodiment, the base section 12 consists of top portion 12*a* and bottom portion 12*b*. The top and bottom portions 12*a* and 12*b* are formed such that the interior of base section 12 is generally hollow.

Figure 7:
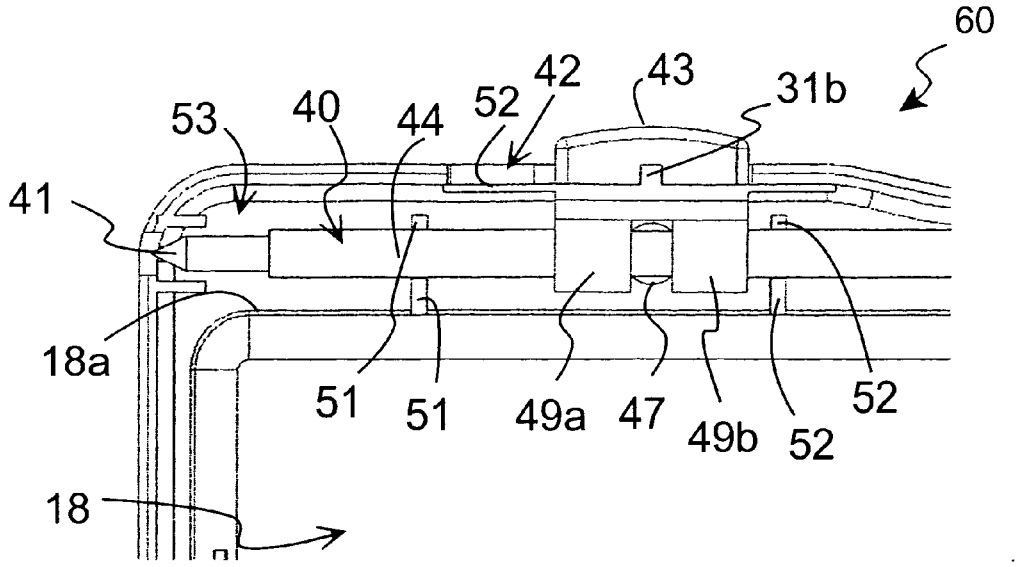
FIG. 7 illustrates the base of the housing of the device shown in FIG. 1 as partially disassembled, in which the projection/retraction assembly is shown disposed in the lower half of the base of the housing.

The disassembled base section 12 is illustrated in FIG. 7. The right side 136 of base 12 and right wall 18*a* of recess 18 cooperate to form a chamber 53 to receive the writing instrument 40. The chamber 53 is positioned to the right of recess 18 and is coincident with the aperture 19.

Figure 8:
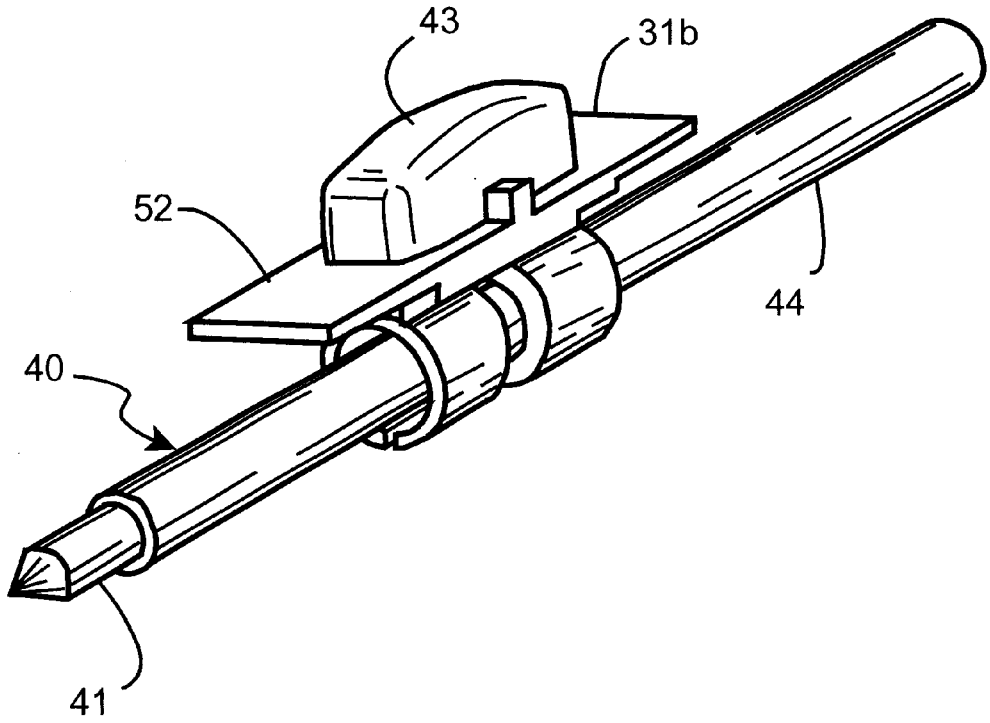
FIG. 8 illustrates a perspective view of the writing instrument attached to the sliding button of projection/retraction assembly.

Any conventional mechanical means to project and retract the writing tip 41 can be used in accordance with the invention. The elements of the projection/retraction assembly 60 according to the preferred embodiment of the present invention are shown in FIG. 7. The projection/retraction assembly 60 includes the sliding button 43 which is fixedly attached to the writing instrument 40 by means of clamp assembly 49. The perspective view shown in FIG. 8 illustrates the sliding button 43 attached to the writing instrument 40. The sliding button 43 is mounted on a base 52 and has a right tab 31*b* extending therefrom. The sliding button 43 is symmetrical, and includes a corresponding left tab 31*a* not shown in FIG. 8. Annular clamp portions 49*a,b* which serve to grasp the writing instrument 40 are integrally formed with the base 42. Referring again to FIG. 9, it is seen that the writing instrument 40 includes a flange 47 along the length of the writing instrument shaft 44 which is positioned between the annular clamp portions 49*a,b*. The flange 47 serves to prevent the writing instrument 40 from sliding in the annular clamp portions 49*a,b*. The writing instrument 40 is secured in an aligned position in the chamber 53 by supports 51 and 52.

The sliding button 43 is slidably disposed in slot 42. The length of slot 42 is sized so that the writing tip 41 is projected out of aperture 19 a sufficient distance to enable a user to write with the pen when the sliding button 43 is in the most forward position.

Figure 9:
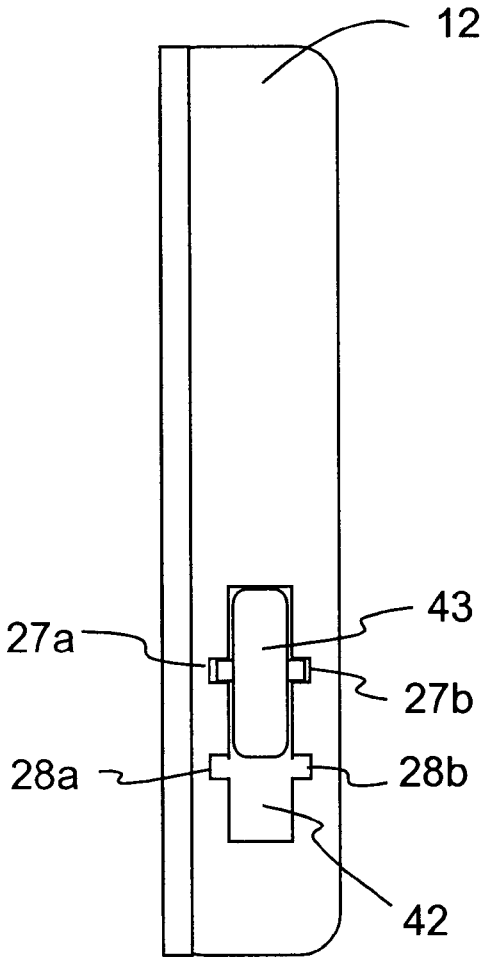
FIG. 9 illustrates a side view of embodiment shown in FIG. 1 showing the position of the sliding button within the slot in the retracted position.
Figure 10:
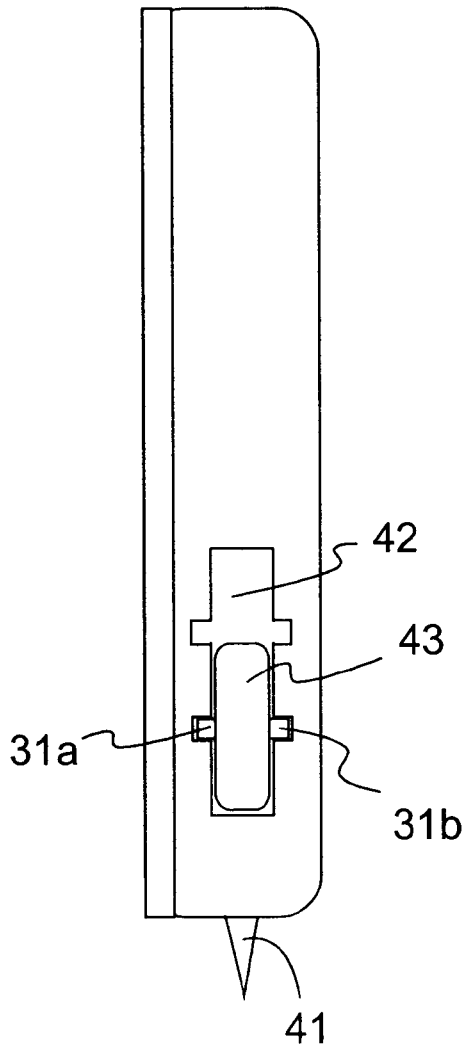
FIG. 10 illustrates a side view of embodiment shown in FIG. 1 showing the position of the sliding button within the slot in the projected position
Figure 11:
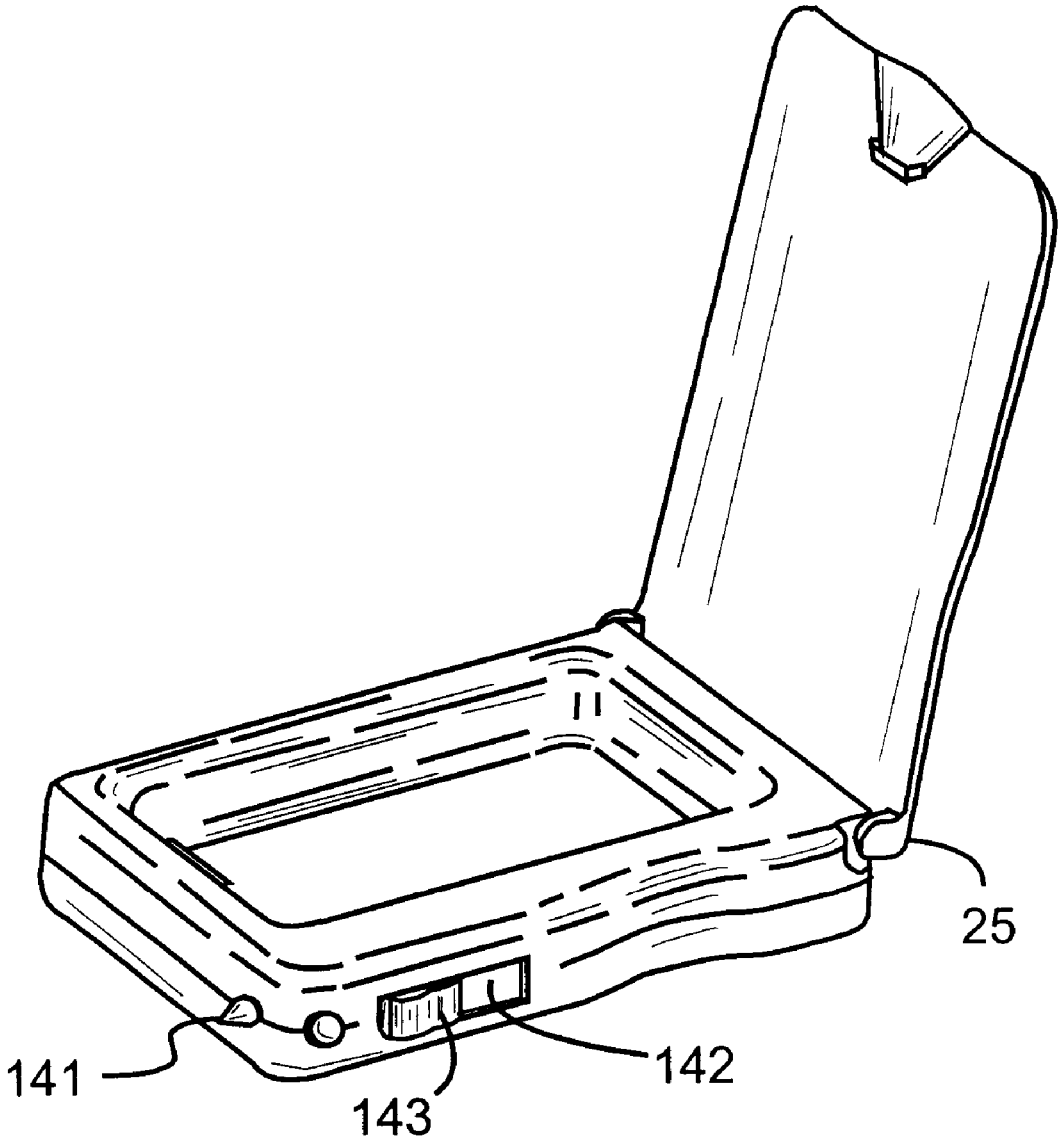
FIG. 11 illustrates an alternative embodiment of the present invention.

The operation of the projection/retraction mechanism is shown in FIGS. 9 and 10. The slot 42 includes lateral perpendicularly extending tab slots 27*a,b* and 28*a,b*. The retracted position of sliding button 43 is shown in FIG. 9 in which the tabs 31*a,b* are seated in tab slots 27*a,b*. In FIG. 11, the sliding button 43 is in the projected position. The sliding button has been moved to seat the tabs 31*a,b* in the tab slots 28*a,b,* thus projecting the writing instrument 40 through aperture 19.

The mechanics of the displacement of the sliding button 43 can be understood in the context of FIG. 9. In practice of the present invention, the writing instrument 40 has a shaft 44 formed from a flexible, non-deformable material which can be bent using manual pressure without damaging or permanently distorting the writing instrument 40. A suitable writing instrument is a standard plastic ink reservior with a writing tip similar to that used a ball point pen refill. To move the sliding button 43 within the slot 42 to project the writing tip 41, the sliding button 43 is manually pushed downward to unseat the tabs 31*a,b* from the tab slots 27*a,b*. The tabs are 31*a,b* are then positioned within the chamber 53. The sliding button 43 is then manually moved a sufficient distance to translate the tabs 31*a,b* through the chamber 53 and then align the tabs 31*a,b* with slots 28*a,b*. It can be seen that manually depressing the sliding button 43 depresses the writing instrument shaft 44 against the supports 51 and 52, thus providing arcuate distortion between the supports 51 and 52, which bends the writing instrument shaft 44 a sufficient amount to unseat the tabs 31*a,b* and allow the displacement of the sliding button 43. When the sliding button 43 is released, the writing instrument shaft 44 returns to its original, substantially straight form, and tabs 31*a,b* are urged upwardly to seat themselves in slots 28*a,b*. The flexibility of the material of the writing instrument shaft 44 in cooperation with the supports 51 and 52 thus provide the necessary spring biasing for the operation of the device.

Figure 12:
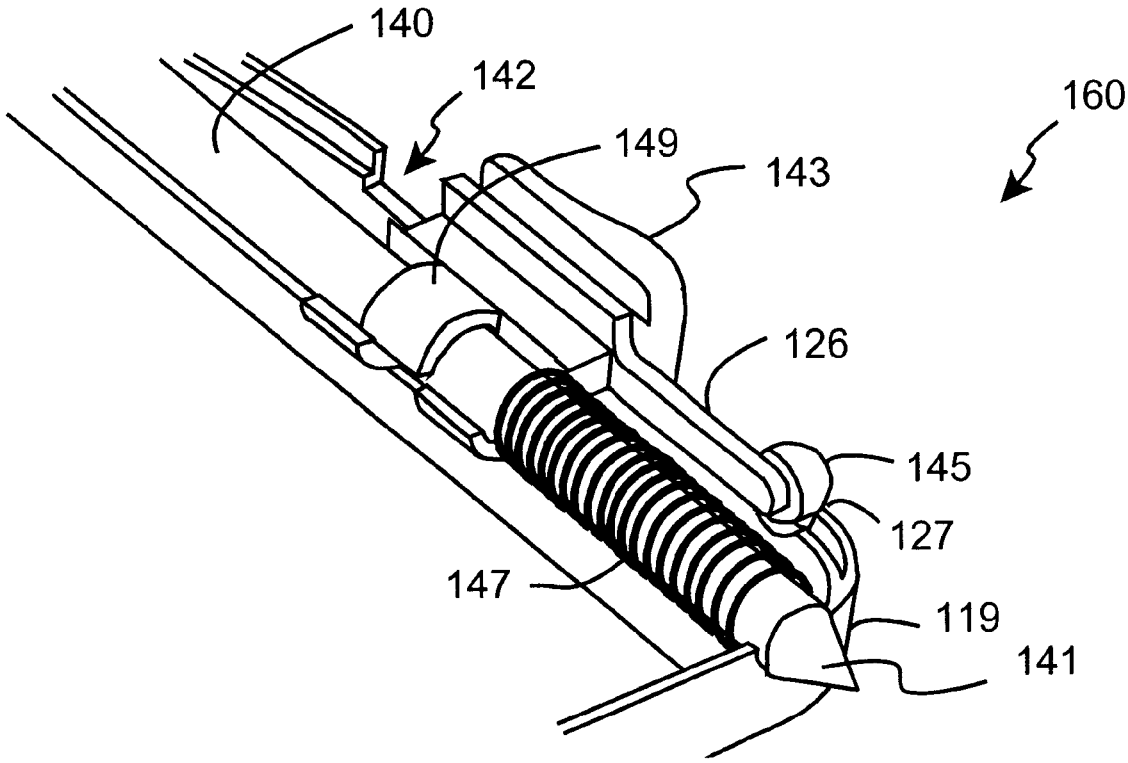
FIG. 12 illustrates the projection/retraction assembly of the embodiment shown in FIG. 11.

FIG. 11 illustrates an embodiment of the invention having a alternative projection/retraction arrangement. FIG. 12 illustrates the projection/retraction assembly 160 for the embodiment shown in FIG. 11. The projection/retraction assembly 160 includes the sliding button 143 which is fixedly attached to the writing instrument 140 by means of clamp assembly 149. In the preferred embodiment, the upper and lower portions of clamp assembly 149 are formed with sufficient tension that the writing instrument 140 is grasped tightly and securely by the clamp assembly 149. A helical spring 147 is slidingly coiled around the writing instrument 140 proximate the writing tip 141 and is held in place between clamp assembly 149 and the perimeter of aperture 119. The sliding button 143 is slidably disposed in slot 142. The length of slot 142 is sized so that the writing tip 141 is projected out of aperture 119 a sufficient distance to enable a user to write with the pen when the sliding button 143 is in the most forward position. The sliding button 143 is connected to a retraction button 145 by means of a extension member 126. The extension member 126 biases the retraction button outwardly so that the retraction button 145 will seat itself in the retraction button aperture 127 when the sliding button 143 is moved forwardly. When the writing instrument 140 is projected, the retraction button 145 is seated in the retraction button aperture 127 and the clamp assembly 149 compresses the spring 147. The extension member 126 is formed from a somewhat flexible, deformable material so that a user can push the retraction button 145 downwardly, and the tension in the compressed spring 147 will return the writing instrument 40 to the retracted position.

The housing 11 of the device 10 can be formed from any suitable materials which are rigid and lightweight. The preferred embodiment of the present invention is formed from injection molded plastic. The housing 11 can also be constructed from lightweight metals.

In another aspect of the invention, the device 10 can be used a promotional item. The top and bottoms surfaces of the lid 14 can be used indicia for advertising and promotional purposes. The notepad 48 can similarly be printed with promotional material.

While the device 10 has been described as having a generally rectangular form, the invention is not limited in this regard. The housing 11 of the device 10 can have any suitable shape in which a writing instrument, a projection/retraction assembly and a notepad storage recess are provided in the manner herein described. The device 10 of the invention is configured to be relatively small in size, and is preferably approximately "pocket-sized" so that it can be conveniently carried. In the preferred embodiment, the width and length of the device 10 are approximately equal to a the size of a standard credit card. The height and length of the device 10 must be sufficient to accommodate the writing instrument 40 and the projection/retraction assembly. The overall dimensions are dictated by the size and configuration of the paper or notepad to be stored in the device 10.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

I claim:

1. A notepad holder with an integrated writing instrument, comprising:

a generally rectangular base section defined by a top surface, opposing front and rear surfaces and opposing left and right side surfaces, said top surface having a recessed area with opposing side surfaces and opposing front and rear surfaces, said base section having an instrument chamber therein adjacent to said recessed area, said front surface including an aperture aligned with said instrument chamber;

a writing instrument including a writing tip stored within said instrument chamber;

means to alternatively selectively position said writing tip between a retracted position within said instrument chamber and a projected position extending through said aperture;

a lid section hingedly coupled to said base section providing a cover for said recessed area, wherein said recessed area is available for holding various sized notepads whereby said writing instrument is available for a user to write messages on the notepad.

2. The device according to claim 1, wherein at least one of said opposing left and right side edges of said base section includes a vertically oriented arcuate recess adapted to facilitate manual gripping of the device by a user to utilize the writing instrument.

3. The device according to claim 1, further comprising a notepad disposed in said recess.

4. The device according to claim 1, wherein said lid section and said base section include mated portions to secure said lid in a closed position.

5. The device according to claim 1, wherein said base section and said lid section is formed from injection molded plastic.

6. The device according to claim 1, wherein said means to alternatively selectively position said writing tip between a retracted position and a projected position comprises:

an elongated slot in said base section having first and second sets of extending tab slots extending laterally and perpendicularly therefrom, wherein said first set corresponds to a retracted position and said second set corresponds to a projected position;

a button slidably disposed in said slot, said sliding button integrally formed with a clamp assembly fixedly attached to said writing instrument, said button having integrally formed lateral tabs adapted to engage with one set of said tab slots, wherein said tabs are seated in the first set of tabs slots in retracted position and in said second set of tab slot in the projected position; wherein said sliding button can be manually depressed to unseat said tabs from said tab slots by downwardly displacing said sliding button; and spring biasing means wherein said tabs are urged upwardly to reseat themselves in said one set of tab slots after downward displacement.

7. The device according to claim 6, wherein said spring biasing means is a writing instrument having a shaft constructed of a flexible, non-deformable material.

8. The device according to claim 1, wherein said writing instrument is a ball point pen.

9. The device according to claim 1, where said writing instrument is a felt pen.

10. The device according to claim 1, wherein said writing instrument is a mechanical pencil.

11. The device according to claim 1, wherein said means to alternatively selectively position said writing tip between a retracted position and a projected position comprises:

an elongated slot and a retraction button aperture extending through one of said side surface of said base section;

a button slidably disposed in said slot, said sliding button integrally formed with a clamp assembly fixedly attached to said writing instrument;

a spring slidably disposed on said writing instrument, said spring captured between said aperture in said front face of said base section and said clamp assembly; and an extension member extending from said clamp assembly, said extension member terminating in a retraction button, wherein said retraction button is seated in said retraction button aperture in said projected position whereby said spring will urge said writing instrument to said retracted position when said retraction button is manually unseated from the retraction button aperture.

* * * * *